US009306344B2

(12) United States Patent
McLaughlin et al.

(10) Patent No.: US 9,306,344 B2
(45) Date of Patent: Apr. 5, 2016

(54) COMPUTING DEVICE CONNECTORS

(71) Applicant: Microsoft Technology Licensing, LLC, Redmond, WA (US)

(72) Inventors: Robyn Rebecca Reed McLaughlin, Seattle, WA (US); Andrew William Hill, Redmond, WA (US); Nathan Thome, Seattle, WA (US); Jan Raken, Seattle, WA (US); John Stephen Campbell, Spanaway, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 52 days.

(21) Appl. No.: 14/227,704

(22) Filed: Mar. 27, 2014

(65) Prior Publication Data

US 2015/0280371 A1 Oct. 1, 2015

(51) Int. Cl.

| | |
|---|---|
| ***H01R 13/60*** | (2006.01) |
| ***H01R 13/73*** | (2006.01) |
| ***H01R 13/74*** | (2006.01) |
| *H01R 12/70* | (2011.01) |
| *H01R 12/72* | (2011.01) |
| *H01R 13/6582* | (2011.01) |
| *H01R 13/6594* | (2011.01) |

(52) U.S. Cl.

CPC ..... *H01R 13/73* (2013.01); *H01R 13/743* (2013.01); *H01R 12/707* (2013.01); *H01R 12/721* (2013.01); *H01R 12/725* (2013.01); *H01R 13/6582* (2013.01); *H01R 13/6594* (2013.01)

(58) Field of Classification Search

CPC .. H01R 12/716; H01R 13/6581; H01R 13/73; H01R 13/743; H01R 13/6594; H01R 12/721; H01R 12/707; H01R 13/6582

USPC ..... 439/538

See application file for complete search history.

(56) References Cited

U.S. PATENT DOCUMENTS

| | | | | |
|---|---|---|---|---|
| 7,896,706 | B1 | 3/2011 | Peng et al. | |
| 8,047,880 | B2 | 11/2011 | Fields et al. | |
| 8,221,137 | B2 | 7/2012 | Zheng et al. | |
| 2009/0034217 | A1 | 2/2009 | Hamner et al. | |
| 2009/0298332 | A1 | 12/2009 | Murr et al. | |
| 2010/0045581 | A1* | 2/2010 | Yeon | 345/87 |
| 2010/0225306 | A1* | 9/2010 | Slaton | 324/149 |
| 2010/0240259 | A1 | 9/2010 | Murphy et al. | |
| 2011/0255259 | A1 | 10/2011 | Weber et al. | |

(Continued)

FOREIGN PATENT DOCUMENTS

| | | |
|---|---|---|
| EP | 2309413 A1 | 4/2011 |
| EP | 2677604 | 12/2013 |

OTHER PUBLICATIONS

"International Search Report and Written Opinion", Application No. PCT/US2015/022101, Oct. 26, 2015, 15 Pages.

*Primary Examiner* — Jean F Duverne

(74) *Attorney, Agent, or Firm* — Jeremy Snodgrass; Judy Yee; Micky Minhas

(57) ABSTRACT

Computing device connectors are described. In one or more implementations, a connector includes one or more communication contacts configured to support transmission of data and a receptacle secured within an opening of a printed circuit board. The receptacle having the one or more communication contacts disposed therein to support transmission of data upon contact with one or more communication contacts of a plug disposed within the receptacle, the receptacle having an angled outer edge.

20 Claims, 10 Drawing Sheets

(56) References Cited

U.S. PATENT DOCUMENTS

| | | | | |
|---|---|---|---|---|
| 2012/0071027 | A1 | 3/2012 | Yu | |
| 2012/0128169 | A1 | 5/2012 | Tung et al. | |
| 2013/0040501 | A1 | 2/2013 | Peng | |
| 2013/0084736 | A1 | 4/2013 | Strittmatter et al. | |
| 2013/0203290 | A1 | 8/2013 | Zhang | |
| 2013/0330978 | A1 | 12/2013 | Schwalbach et al. | |
| 2015/0200504 | A1 * | 7/2015 | Little et al. | H01R 24/60 |
| 2015/0207279 | A1 * | 7/2015 | Little et al. | H01R 24/60 |

* cited by examiner

COMPUTING DEVICE CONNECTORS

BACKGROUND

The configuration of computing device is ever increasing, from traditional desktop personal computers to mobile computing devices such as mobile phones, tablet computers, and so on. As such, the form factors employed by these devices may also vary greatly. However, conventional techniques to support external connections could limit the configurations and form factors that may be employed by these devices.

For example, conventional connectors may be employed by computing devices to connect to peripheral devices to access additional functionality, power (e.g., the charge the device in a mobile configuration), and so on. However, these convention connectors could have a shape and size that could also limit a size and shape that could be employed by the device in one or more dimensions. Thus, conventional connectors could limit mobility and user interaction with a device due to limitations of these conventional connectors.

SUMMARY

Computing device connectors are described. In one or more implementations, a connector includes one or more communication contacts configured to support transmission of data and a receptacle secured within an opening of a printed circuit board. The receptacle having the one or more communication contacts disposed therein to support transmission of data upon contact with one or more communication contacts of a plug disposed within the receptacle, the receptacle having an angled outer edge.

In one or more implementations, an apparatus includes a housing configured to be held in one or more hands of a user, a display device positioned at a side of the housing, a surface of the display device defining an axis, and a connector configured to provide a communicative coupling to a peripheral device and disposed on another side of the housing from that of the display device. The connector includes a receptacle having a spring that includes a plurality of spring contacts formed as an integral part of the spring that are configured to flex in opposite directions in relation to each other generally along an axis normal to the surface of the display device in response to insertion of a plug into the receptacle.

A computing device includes a housing configured to be held by one or more hands of a user, one or more computing components implemented at least partially in hardware and configured to perform one or more operations, the one or more computing components disposed within the housing. The computing device also includes a display device secured to the housing and configured to display a user interface generated by the one or more computing components, and a connector disposed in the housing and configured to provide a communicative coupling between the one or more computing components and a peripheral device. The connector includes a receptacle having one or more communication contacts disposed therein that are configured to support the communicative coupling upon contact with one or more communication contacts of a plug disposed within the receptacle. The receptacle has an outer edge disposed at an angle that is not normal, generally, to an axis of the receptacle that is configured to permit insertion and removal of the plug.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Conventional connectors for computing devices used a common configuration in which an outer edge of a receptacle of the connector was normal to an axis via which a plug is to be inserted into and removed from the receptacle. In other words, the outer edge is typically perpendicular and flat in conventional configurations of connectors used to support an external connection to peripheral devices.

A variety of different types of connections may be supported, for instance, such as to provide a communicative coupling (e.g., memory sticks, printers, hard drives, display devices), a powered connection (e.g., to charge the peripheral device and/or the computing device), and so on. Consequently, these conventional connectors could limit how and where the connectors may be employed by the computing device, which may have an effect on a size of the device (e.g., depth), shape of the device (e.g., to include flat edges that include the connectors which could depart from an overall desired effect of the device and thereby limit functionality of the device), and so forth.

Computing device connectors are described. In one or more implementations, connectors are configured that may depart from a conventional limitation of an outer edges as being flat and perpendicular to an axis of insertion. A connector, for instance, may include a receptacle that includes an outer edge that is formed to have an angle relative to the axis of insertion. In this way, the connector may be configured to follow an angle of a housing that includes the connector and thus avoid conventional "flattened" portions of housing that were utilized to include conventional connectors. Additionally, the connectors may be configured to mimic a vent pattern of the computing device and thus promote cooling of the device through uninterrupted airflow as was encountered in conventional configurations. Further, the connectors may be configured to promote a compact form factor, such as to reduce thickness of a computing device and thus increase portability of the device, e.g., through use of a mid-mount design, integrated display device support, and so on. Further discussion of these and other examples may be found in relation to the following sections.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
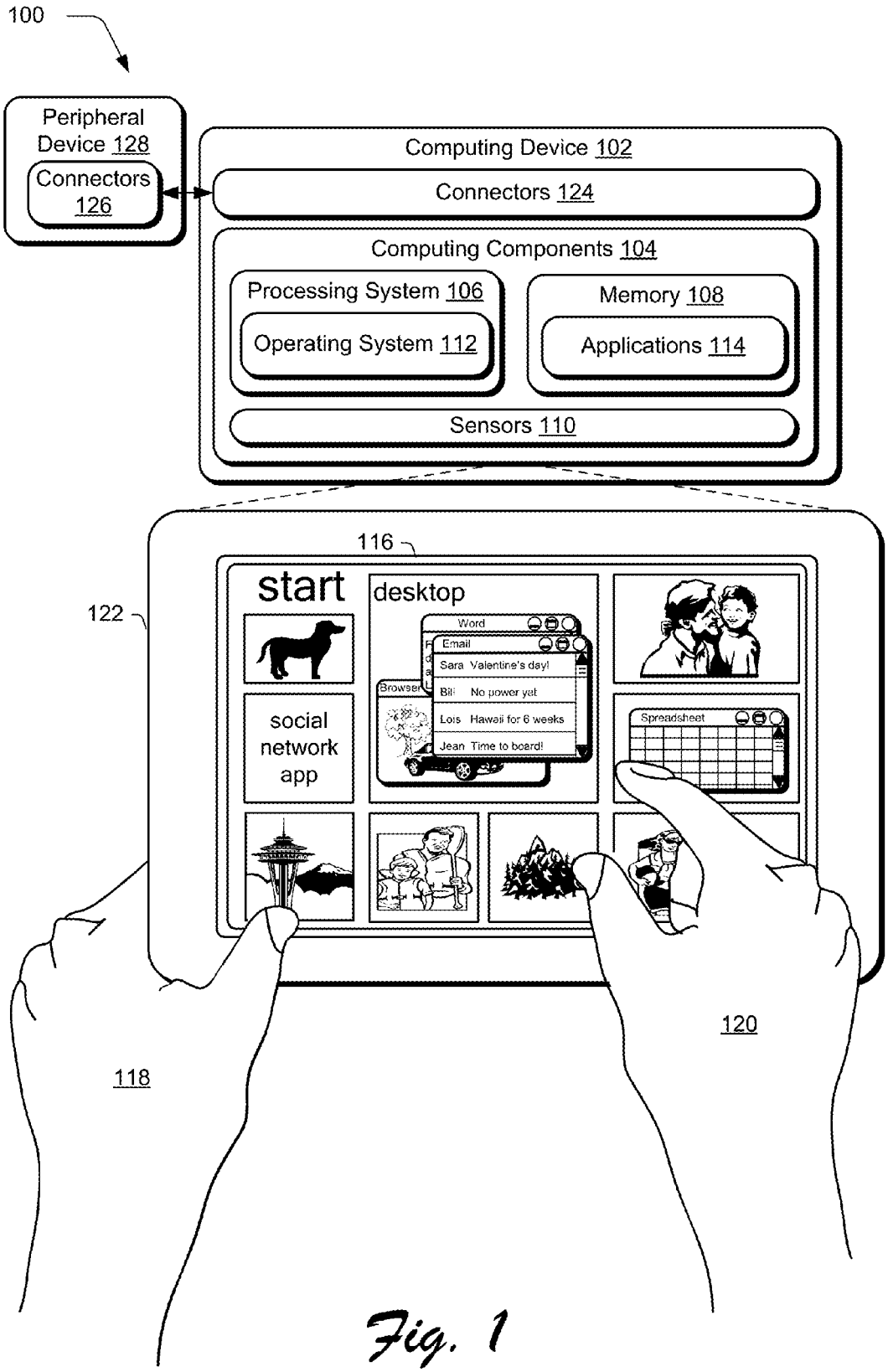
FIG. 1 is an illustration of an environment in an example implementation that is operable to employ a display device utilizing the connector techniques described herein.

FIG. 1 is an illustration of an environment 100 in an example implementation that is operable to employ the connector techniques described herein. The illustrated environment 100 includes a computing device 102. In this example, the computing device 102 includes one or more computing components 104 which may be configured to perform and/or assist in performance of one or more operations of the computing device 102, e.g., in execution of instructions specified by software. Examples of computing components 104 include a processing system 106, memory 108, and sensors 110 with examples of software that include an operating system 112 and applications 114.

The computing device 102 may be configured in a variety of ways. For example, a computing device may be configured as a computer that is capable of communicating over a network, such as a desktop computer, a mobile station, an entertainment appliance, a set-top box communicatively coupled to a display device, a wireless phone, a game console, educational interactive devices, point of sales devices, and so forth. Thus, the computing device 102 may range from full resource devices with substantial memory and processor resources (e.g., personal computers, game consoles) to a low-resource device with limited memory and/or processing resources (e.g., traditional set-top boxes, hand-held game consoles). Additionally, although a single computing device 102 is shown, the computing device 102 may be representative of a plurality of different devices, such as multiple servers utilized by a business to perform operations such as by a web service, a remote control and set-top box combination, an image capture device and a game console configured to capture gestures, and so on. In addition, it may apply to apparatuses including a plurality of display devices, e.g., a clam shell configuration.

The computing device 102 may support a variety of different interactions. For example, the computing device 102 may include one or more hardware devices that are configured to be manipulated by a user to interact with the device, such as a keyboard, cursor control device (e.g., mouse), and so on. The computing device 102 may also support gestures, which may be detected in a variety of ways. The computing device 102, for instance, may support touch gestures that are detected using touchscreen functionality of the computing device 102.

The sensors 110, for instance, may be configured to provide touchscreen functionality in conjunction with the display device 116. The sensors 110 may be configured as capacitive, resistive, acoustic, light (e.g., sensor in a pixel), and so on that are configured to detect proximity of an object. An example of this is illustrated in FIG. 1 in which first and second hands 118, 120 of a user are illustrated. The first hand 118 of the user is shown as holding a housing 122 (e.g., external enclosure) of the computing device 102. The second hand 120 of the user is illustrated as providing one or more inputs that are detected using touchscreen functionality of the display device 116 to perform an operation, such as to make a swipe gesture to pan through representations of applications in the start menu of the operating system 112 as illustrated. This may also apply to user input with an active or passive stylus.

The computing device 102 is also illustrated as including one or more connectors 124 that are configured to support a physical connection to connectors 126 of a peripheral device 128. The physical connection, for instance, may be configured to support a communicative coupling to support transmission of data, such as for use in a Universal Serial Bus, display port (e.g., mini display port), audio jack, microphone jack, Thunderbolt® connection, FireWire® connection, and so forth. The physical connection may also be configured to support a transfer of power, such as part of a Universal Serial Bus configuration, a dedicated power connection, and so on.

Thus, the peripheral device 128 may assume a variety of different configurations such as an output device (e.g., display device, printer, speakers, headphones), input device (e.g., keyboard, mouse, camera in support of a natural user interface or webcam), storage device (e.g., memory device), communication device (e.g., network connection device), and so on. Additionally, the connectors 124, 126 of the computing device 102 and the peripheral device 128 may also be configured in a wide variety of ways and as such, although the following discussion includes examples of a Universal Serial Bus, display port, and audio jack (e.g., that may support output of audio and input as a microphone) other configurations and arrangements are also contemplated without departing from the spirit and scope thereof.

Figure 2:
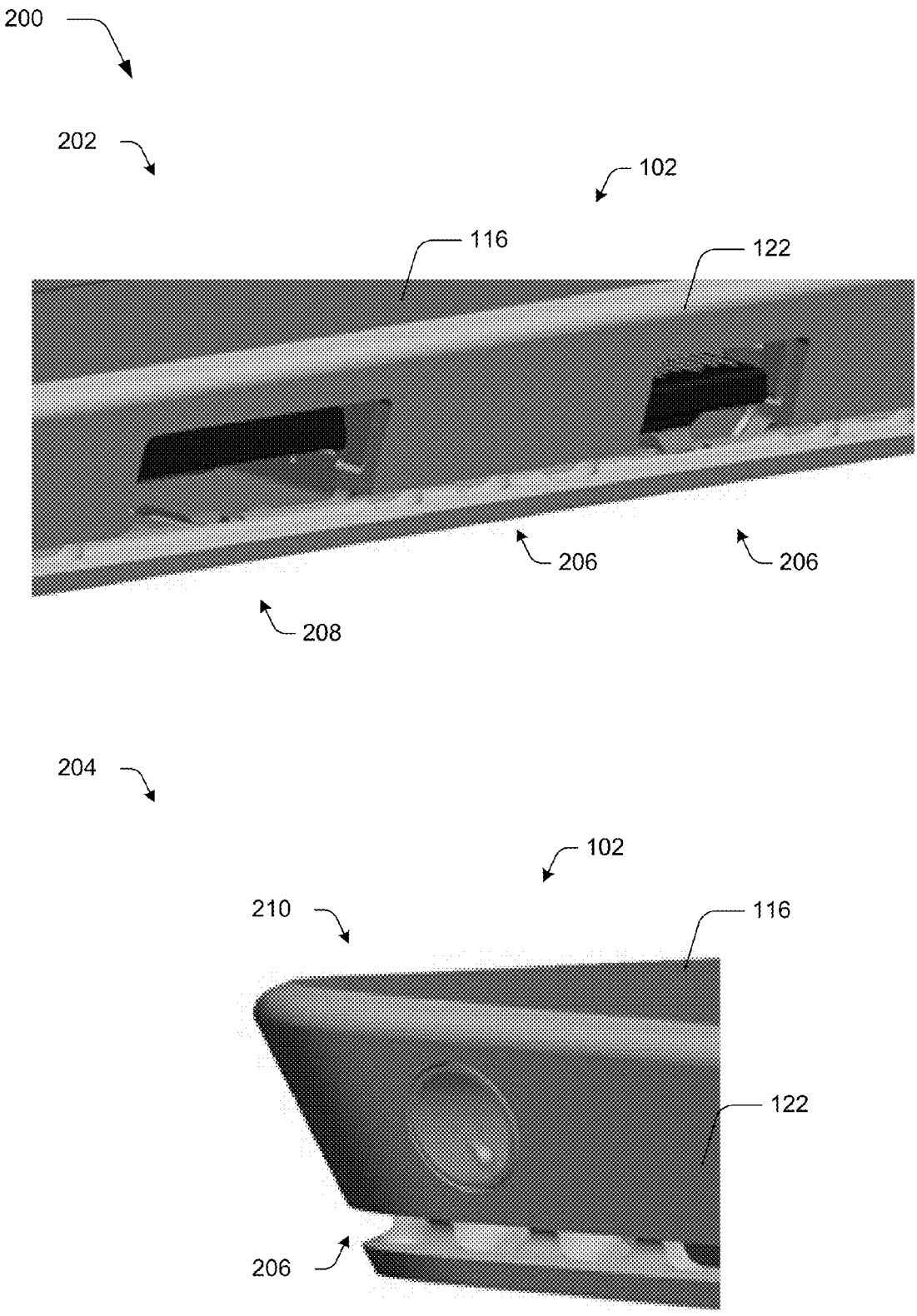
FIG. 2 is an illustration of an example implementation showing first and second perspective views of sides of a housing of FIG. 1.

FIG. 2 is an illustration of an example implementation 200 showing first and second views 202, 204 perspective views of the sides of the housing 122 of FIG. 1. In this example, the display device 116 is secured to the housing 122 and forms a top surface via which a user may view and interact with the display device 116 as shown previously in relation to FIG. 1. The side of the housing 122 in this example is disposed at an angle that is not normal (e.g., perpendicular) in relation to a plane defined by an outer surface of the display device 116. Vents 206 are also formed in the housing 122 to permit airflow and promote cooling of computing components 104 of FIG. 1 that are disposed within the housing.

The first view 202 includes examples of connectors 124 that include a mini display port (mDP) connector 206 and a Universal Serial Bus (USB) connector 208. The second view 202 includes an example of a connector 124 formed as an audio jack 210. As previously described other examples of connectors 124 are also contemplated.

Conventional connectors included an outer surface that is normal to an axis of insertion for the connector. Accordingly, use of such connectors was not possible in a situation as shown in FIG. 2 in which the side of the housing 122 forms an angle. In this example, however, an outer surface of receptacles of the mDP connector 206, USB connector 208, and audio jack 210 is configured to form an angle that mimics the angle formed by the housing 122. In this way, the connectors may be utilized in a wide variety of instances that were not previously possible.

Further, the connectors may be configured to promote a compact form factor. For example, a surface of the display device may define a plane having an x and y axis. Accordingly, a z axis may also be defined that is perpendicular to this plane, which corresponds to a thickness of the computing device 102 in this example. The connectors may be formed to minimize a thickness of the computing device 102 along the z axis and thus promote this compact form factor and accordingly mobility, functionality, and portability of the computing device, an example of which is described as follows and shown in a corresponding figure.

Figure 3:
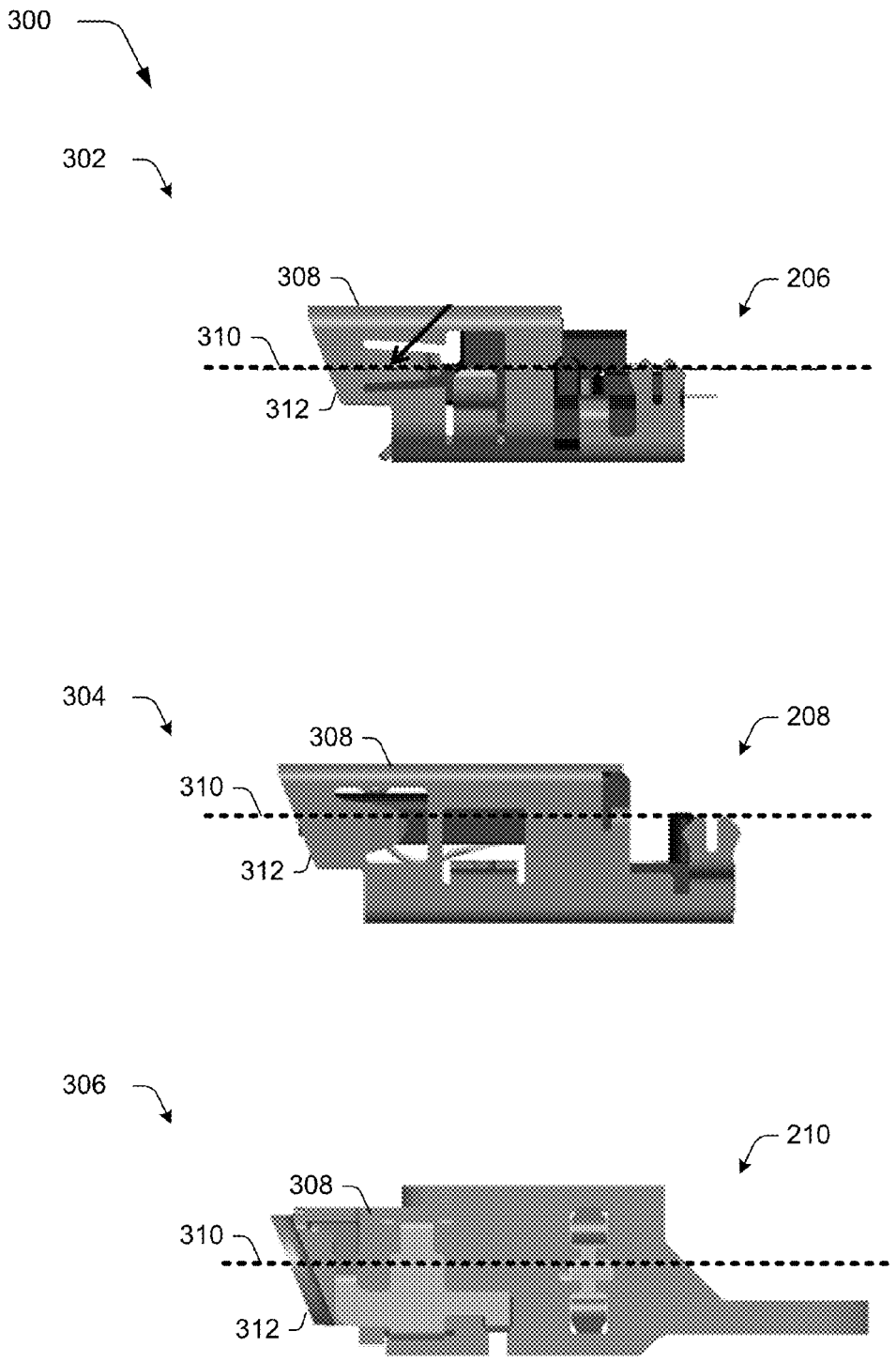
FIG. 3 depicts an example implementation showing first, second, and third profile views of a mDP connector, USB connector, and audio jack of FIG. 2.

FIG. 3 depicts an example implementation showing first, second, and third profile views 302, 304, 306 of the mDP connector 206, USB connector 208, and audio jack 210 of FIG. 2. As shown in the profile views 302-306, the mDP connector 206, USB connector 208, and audio jack 210 each include a receptacle 308 having an axis 310 via which a plug may be inserted into and removed from the receptacle 308.

The receptacle 308 has an outer edge 312 that defines an outer opening of the receptacle 308. As illustrated, an angle of the outer edge 312 is not normal to the axis, which in this instance is an angle of twenty-two degrees to a plane normal to the axis 310. In other words, the angle is twenty-two degrees from vertical in the illustration and thus mimics an angle of a side of the housing 122 of FIG. 2. It should be readily apparent that other non-normal angles are also contemplated without departing from the spirit and scope thereof.

Figure 6:
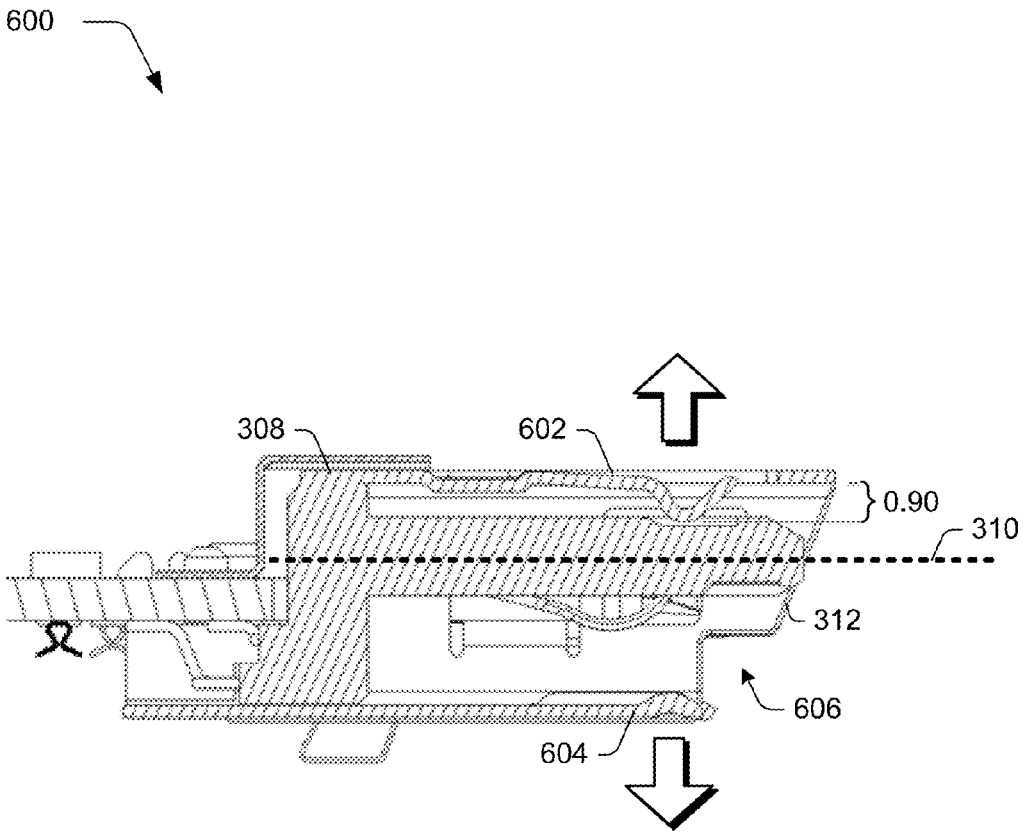
FIG. 6 depicts an example implementation showing the USB connector of FIG. 5 using a cutaway.

To support this non-normal angle to the outer surface 312 of the receptacle 308 of the connector, springs may be reconfigured in both positioning and strength to support use of conventional plugs with the receptacle as further described beginning in relation to FIG. 6. The receptacle 308 may also be configured to support a compact form factor, an example of which is described as follows and shown in a corresponding figure.

Figure 4:
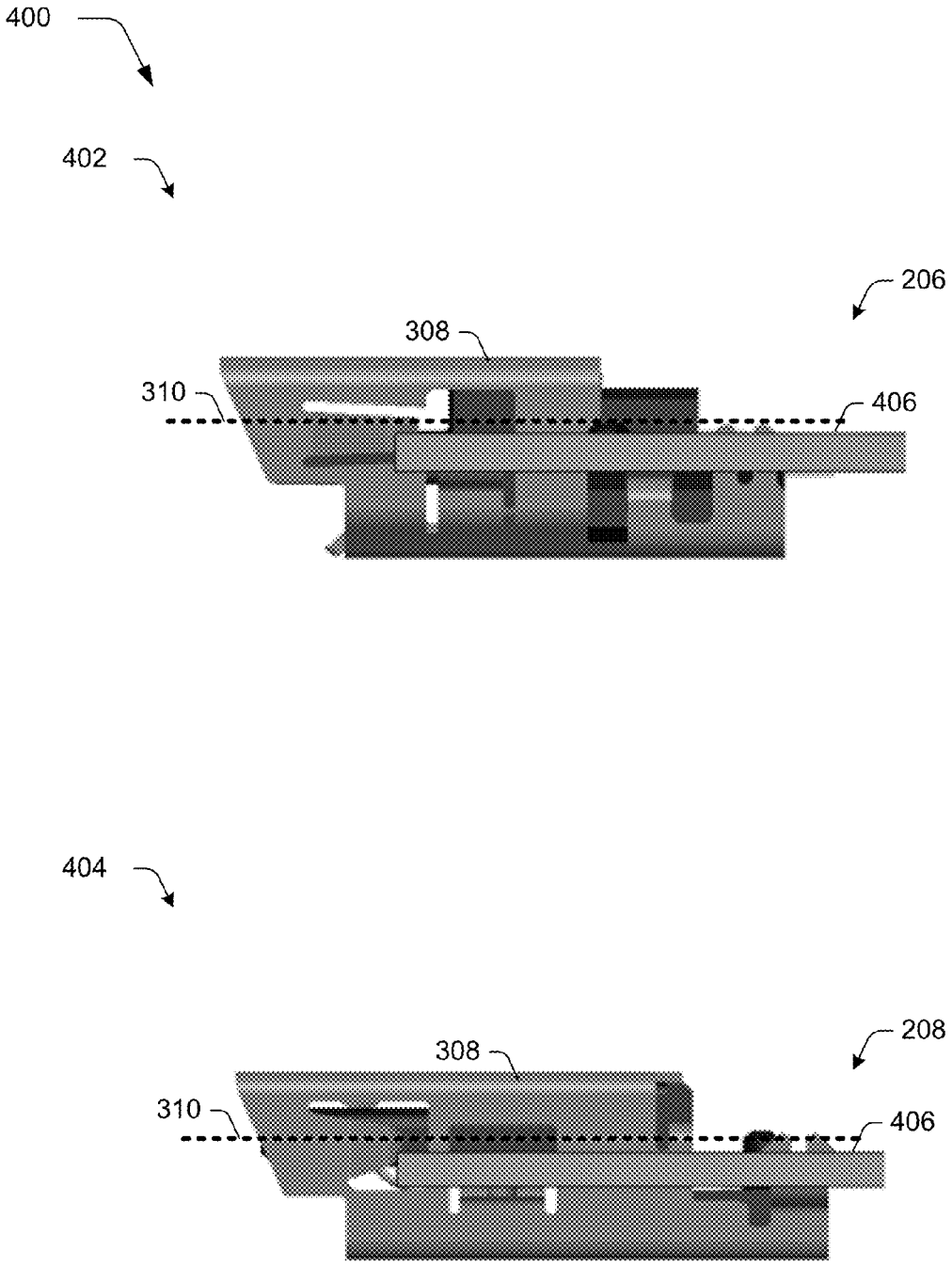
FIG. 4 depicts an example implementation showing first and second profile views of the mDP connector and USB connector of FIG. 3 as employing a mid-mount design for attachment to a printed circuit board.

FIG. 4 depicts an example implementation showing first and second profile views 402, 404, of the mDP connector 206 and USB connector 208 of FIG. 3 as employing a mid-mount design for attachment to a printed circuit board 406. Conventional techniques to mount connectors to a printed circuit board (PCB) involved placing the connector on the top or bottom surface of the PCB. However, this could have an adverse effect on an overall thickness of a computing device that employs the connector as previously described in relation to FIG. 2 as well as interfere with other functionality of the device, e.g., block vents in the device.

Accordingly, in order to place an opening of the receptacle 308 in a desired location along a sidewall of the housing 122 of FIG. 2, an opening is formed in a printed circuit board 406, in which, the mDP connector 206 and USB connector 208 are disposed in this example. The connectors are then secured within this opening. In this way, a thickness of the printed circuit board 408 is not added to a thickness of the connector when forming the computing device 102 and thus space along a z axis as previously described is conserved. In this example, the printed circuit board 406 defines a plane that parallels the axis 310 of insertion and removal of the plug from within the receptacle 308.

Figure 5:
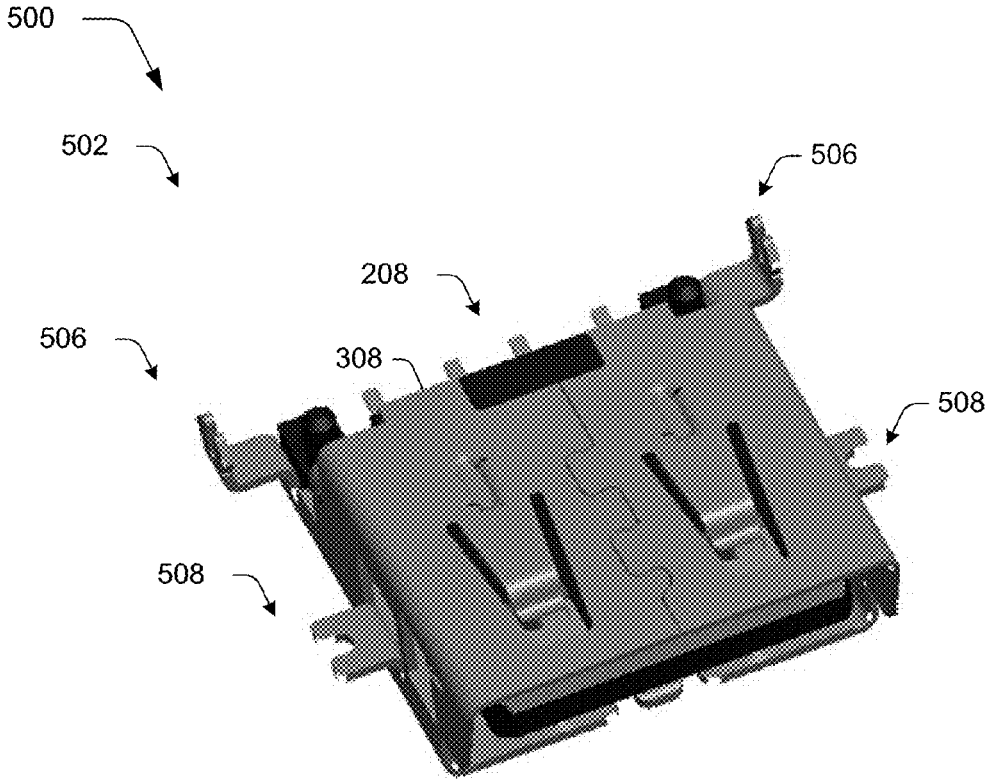
FIG. 5 depicts an example implementation showing first and second views of the USB connector of FIG. 4 in greater detail as being configured to support mid mounting in relation to a printed circuit board.
Figure 5:
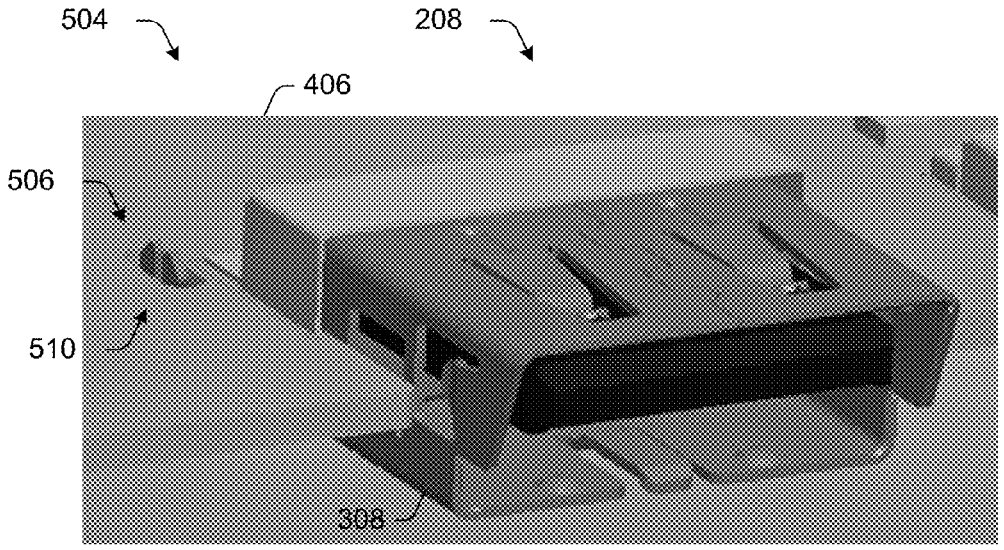

FIG. 5 depicts an example implementation showing first and second views 502, 504 of the USB connector 208 of FIG. 4 in greater detail as being configured to support mid mounting in relation to a printed circuit board 406. The first view 502 is an isometric view showing the receptacle 308 of the USB connector 208. The receptacle 308 includes tabs which have been formed from the same piece of sheet metal that is used to create the receptacle 308 and extend out from the receptacle 308.

This has both cost and functional benefits, which include electromagnetic shielding as this may support soldering of the receptacle 208 to the printed circuit board 406 as shown in the second view 504. For example, the connector may be tied into a ground plane of the PCB 406 to act as an electromagnetic shield for the USB connector 208. Additionally, solder leads may be designed to rest on a surface of the PCB 406, enabling traditional pick and place SMT.

Furthermore, the connector may be configured to withstand physical and mechanical forces that act on it via the insertion and extraction of the plug which is handled by a user of the device. The design of the receptacle 308 in this example supports insertion and extraction interactions in excess of five thousand cycles. Although a USB connector 208 was described in this example, the connector may assume a variety of other configurations without departing from the spirit and scope thereof as previously described.

FIG. 6 depicts an example implementation showing the USB connector 208 of FIG. 5 using a cutaway. As described in relation to FIG. 2, non-normal configuration of an outer surface 312 of the receptacle 308 may involve changes to permit use of conventional plugs. This may include shortening a length of springs 602, 604 on a top and bottom sides of the USB connector 208, the length defined as following the axis 310 of insertion and removal as previously described.

The springs 602, 604 may be configured to flex in opposing directions as illustrated through the use of arrows in the illustration when contacted by a plug being inserted into the receptacle 308. As described above, however, the length of the springs may be reduced due to the angled outer surface 312 of the receptacle 308 and thus if not otherwise configured may not provide a sufficient retention force to a plug inserted into the receptacle 308.

Accordingly, the springs 602, 604 may be configured to increase an amount of retention force available from that length. For example, the springs 602, 604 may be bent "inward" toward a center of the receptacle 308 to increase a biasing force as illustrated. Further, this may be utilized to help limit an amount of travel (e.g., 0.90 millimeters in the figure) of the spring 602 and thus promote a compact form factor along a z axis as described above. A width of the spring 602, 604 may also be increased to improve a retention force as further described in the following.

Figure 7:
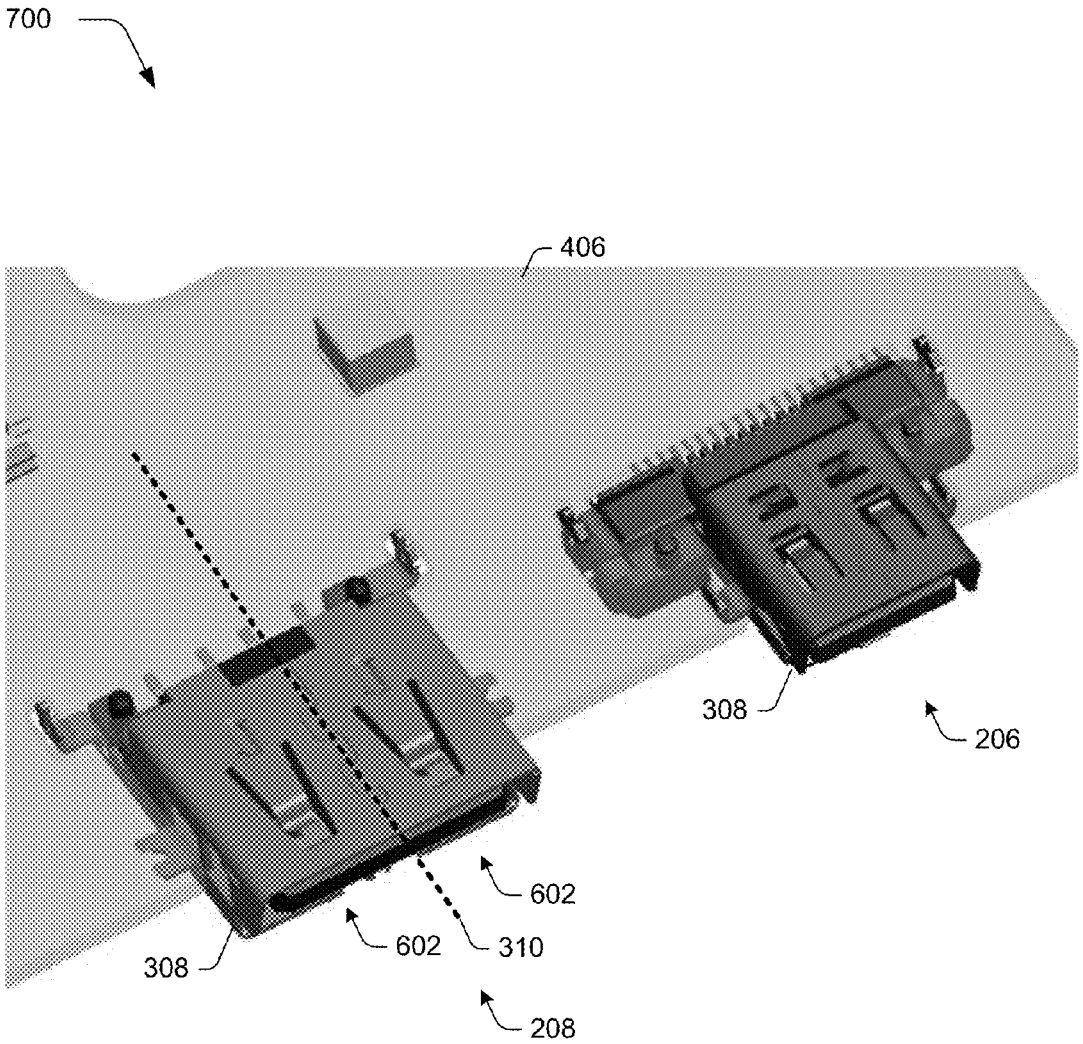
FIG. 7 depicts an example implementation that includes an orthogonal view of the USB connector of FIG. 6 along with the mDP connector of FIG. 4 as being mid-mounted to a printed circuit board.

FIG. 7 depicts an example implementation 700 that includes an orthogonal view of the USB connector 208 of FIG. 6 along with the mDP connector 206 of FIG. 4 as being mid-mounted to a printed circuit board 406. The view shows the springs 602 of the USB connector 208 of FIG. 6 as including a tapered shape.

For example, the springs 602 may start with a contact portion having a conventional size and then increase in width as defined by the axis 310 of insertion and removal. This increase in width may thus improve a retention force of the springs 602 by a corresponding increase in an amount of material being flexed when contact with a plug in the receptacle 308. In this way, the spring 602 may have a shorter length yet still provide a sufficient retention force to a plug as part of a physical and communicative coupling. Although a USB connector 208 was described in this example, it should be readily apparent that other connector configurations may also employ these techniques without departing from the spirit and scope thereof, such as an mDP connector 206 as illustrated or other configuration.

Figure 8:
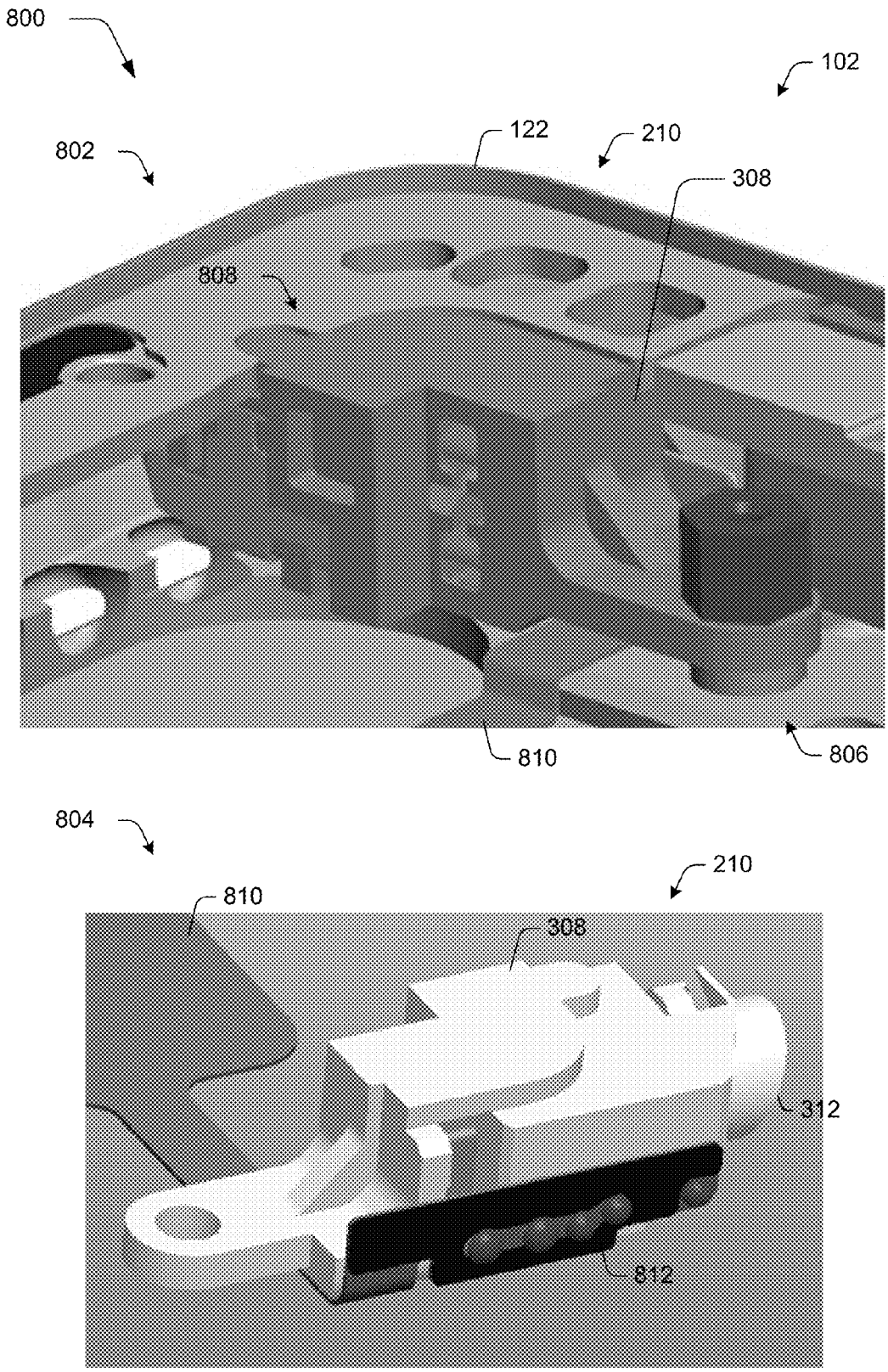
FIG. 8 depicts an example implementation showing first and second views of the audio jack of FIG. 2.

FIG. 8 depicts an example implementation 800 showing first and second view of the audio jack 210 of FIG. 2. In the first view 802, the audio jack 210 is illustrated as being secured within a housing 122 of a computing device 102. The audio jack 210 includes a receptacle 308 as previously described that is configured to receive a plug to form a communicative coupling. The receptacle 308 includes a portion 806 configured to be secured to a circuit board disposed within the housing 122, which is illustrated as a screw in this example although other examples are also contemplated.

The receptacle 308 further includes a protrusion 808 configured to be received within an indentation of the housing 122 to align the receptacle 308 of the audio jack 210 during manufacture. The receptacle 308 is also configured to act as a support for a display device 116 when secured to the housing 122 by having a height that matches a height of a portion of the housing 122 that is to secure the device. In this way, the receptacle 308 of the audio jack 210 may be configured to act as a support between the display device 116 and a printed circuit board disposed within the housing 122.

In the second view 804, a flexible printed circuit 810 is illustrated that is used to communicatively couple the audio jack 210 to a printed circuit board of the computing device 102. Continuing with the previous example, for instance, the display device 116 may be supported by a top side the receptacle 308. To reduce a thickness of the audio jack 210 and the computing device 102 as a whole along the z axis, the flexible printed circuit 810 is connected 812 to a side of the connector 210 that is normal to the surface of the display device 116. Thus, the connection 812 consumes space along a plane defined by an x and y axis (e.g., of a surface of a display device 116) but conserves space along a z axis that is perpendicular to that plane. The flexible printed circuit 810 may then wrap around the receptacle of the audio jack 810 and connect to the printed circuit board 406 of the computing device 102.

Figure 9:
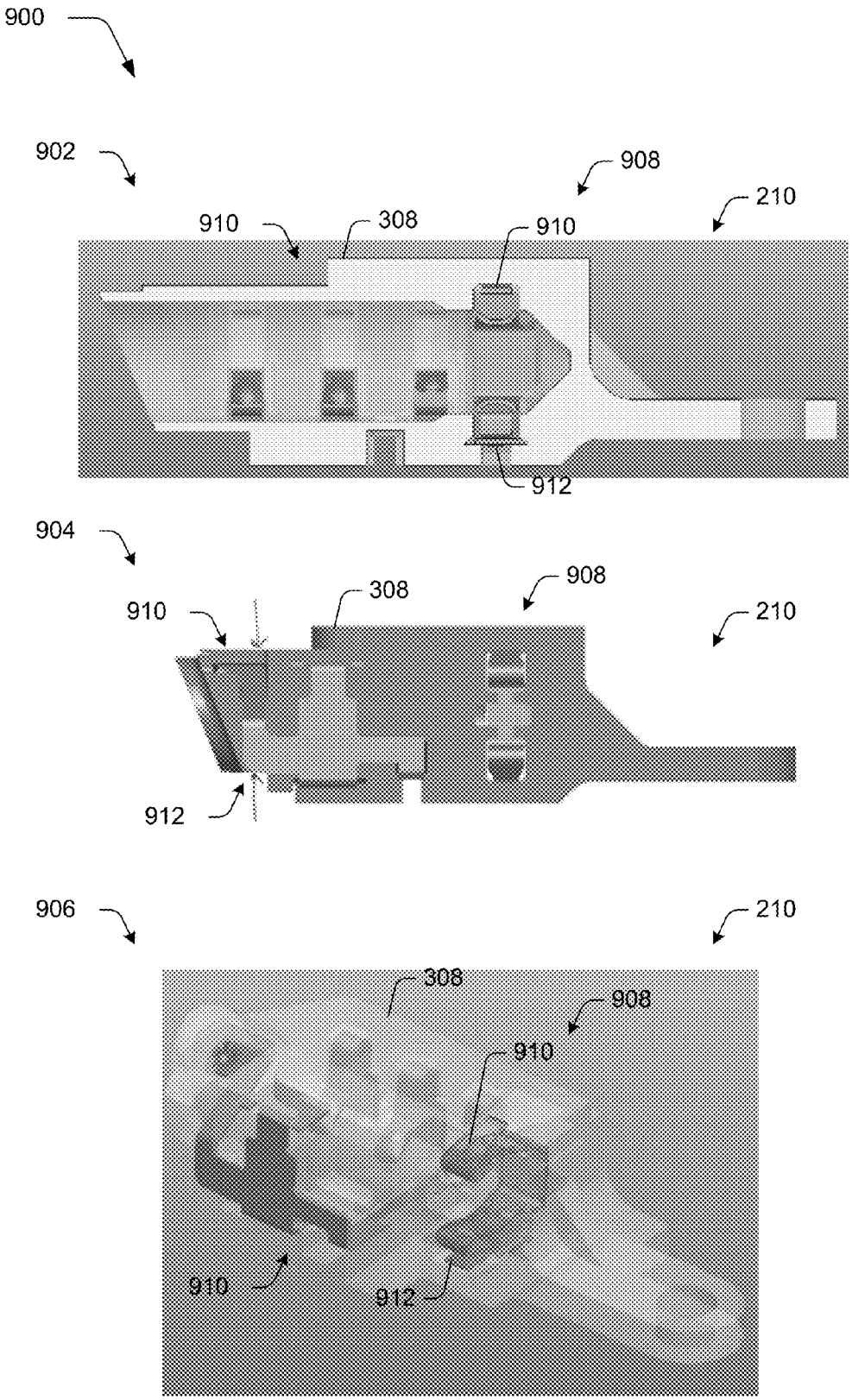
FIG. 9 depicts an example implementation through first, second, and third views of the audio jack of FIG. 8 that includes a spring and spring contacts to form a communicative coupling with a plug of a peripheral device.

FIG. 9 depicts an example implementation through first, second, and third views 902, 904, 906 of the audio jack 210 of FIG. 8 that includes a spring and spring contact to form a communicative coupling with a plug of a peripheral device. Convention audio jack designs used spring contacts formed as individual fingers on the top, bottom, and sides of the connector to make contact with a plug, e.g., for headphones, speakers, and so on. In this example, rather than use spring fingers on the top or bottom that consume space along the z axis and therefore increase thickness of the computing device 102, a spring 908 includes spring contacts 910, 912 that designed to wrap around the sides and take up minimal space on the top and bottom of the receptacle along the z axis. In this way, even though the spring contact may flex in opposing directions along the z axis as shown by the arrows in the second view 904, the movement is limited by the design of the spring 908. The receptacle 308 may also be formed to encourage a compact form factor along the z axis by using a minimal amount of material along the z axis with additional material along a plane defined by the x and y axes. As described above, although a mDP connector, USB connector, and audio jack were described it should be readily apparent that a wide variety of other configurations may also leverage the techniques described herein without departing from the spirit and scope thereof.

Example System and Device

Figure 10:
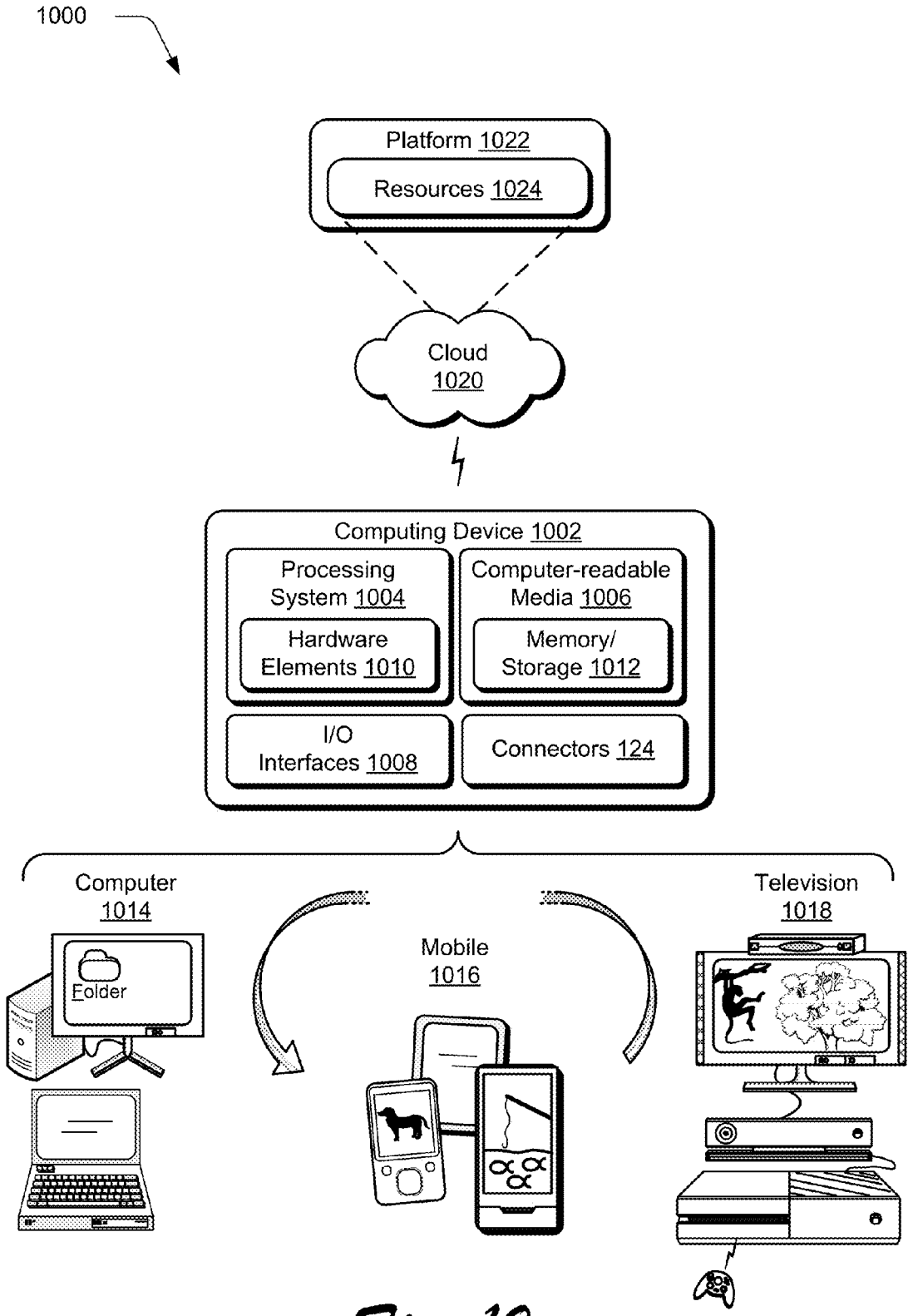
FIG. 10 depicts a system showing an example of various computing devices that may leverage the connectors described herein.

FIG. 10 illustrates an example system generally at 1000 that includes an example computing device 1002 that is representative of one or more computing systems and/or devices that may utilize the various techniques described herein as shown by inclusion of the connectors 124. The computing device 1002 may be, for example, a server of a service provider, a device associated with a client (e.g., a client device), an on-chip system, and/or any other suitable computing device or computing system.

The example computing device 1002 as illustrated includes a processing system 1004, one or more computer-readable media 1006, and one or more I/O interface 1008 that may employ the connectors 124 that are communicatively coupled, one to another. Although not shown, the computing device 1002 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 1004 is representative of functionality to perform one or more operations using hardware. Accordingly, the processing system 1004 is illustrated as including hardware element 1010 that may be configured as processors, functional blocks, and so forth. This may include implementation in hardware as an application specific integrated circuit or other logic device formed using one or more semiconductors. The hardware elements 1010 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 1006 is illustrated as including memory/storage 1012. The memory/storage 1012 represents memory/storage capacity associated with one or more computer-readable media. The memory/storage component 1012 may include volatile media (such as random access memory (RAM)) and/or nonvolatile media (such as read only memory (ROM), Flash memory, optical disks, magnetic disks, and so forth). The memory/storage component 1012 may include fixed media (e.g., RAM, ROM, a fixed hard drive, and so on) as well as removable media (e.g., Flash memory, a removable hard drive, an optical disc, and so forth). The computer-readable media 1006 may be configured in a variety of other ways as further described below.

Input/output interface(s) 1008 are representative of functionality to allow a user to enter commands and information to computing device 1002, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 1002 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 1002. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 1002, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 1010 and computer-readable media 1006 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 1010. The computing device 1002 may be configured to implement particular instructions and/or functions corresponding to the software and/or hardware modules. Accordingly, implementation of a module that is executable by the computing device 1002 as software may be achieved at least partially in hardware, e.g., through use of computer-readable storage media and/or hardware elements 1010 of the processing system 1004. The instructions and/or functions may be executable/operable by one or more articles of manufacture (for example, one or more computing devices 1002 and/or processing systems 1004) to implement techniques, modules, and examples described herein.

As further illustrated in FIG. 10, the example system 1000 enables ubiquitous environments for a seamless user experience when running applications on a personal computer (PC), a television device, and/or a mobile device. Services and applications run substantially similar in all three environments for a common user experience when transitioning from one device to the next while utilizing an application, playing a video game, watching a video, and so on.

In the example system 1000, multiple devices are interconnected through a central computing device. The central computing device may be local to the multiple devices or may be located remotely from the multiple devices. In one embodiment, the central computing device may be a cloud of one or more server computers that are connected to the multiple devices through a network, the Internet, or other data communication link.

In one embodiment, this interconnection architecture enables functionality to be delivered across multiple devices to provide a common and seamless experience to a user of the multiple devices. Each of the multiple devices may have different physical requirements and capabilities, and the central computing device uses a platform to enable the delivery of an experience to the device that is both tailored to the device and yet common to all devices. In one embodiment, a class of target devices is created and experiences are tailored to the generic class of devices. A class of devices may be defined by physical features, types of usage, or other common characteristics of the devices.

In various implementations, the computing device 1002 may assume a variety of different configurations, such as for computer 1014, mobile 1016, and television 1018 uses. Each of these configurations includes devices that may have generally different constructs and capabilities, and thus the computing device 1002 may be configured according to one or more of the different device classes. For instance, the computing device 1002 may be implemented as the computer 1014 class of a device that includes a personal computer, desktop computer, a multi-screen computer, laptop computer, netbook, and so on.

The computing device 1002 may also be implemented as the mobile 1016 class of device that includes mobile devices, such as a mobile phone, portable music player, portable gaming device, a tablet computer, a multi-screen computer, and so on. The computing device 1002 may also be implemented as the television 1018 class of device that includes devices having or connected to generally larger screens in casual viewing environments. These devices include televisions, set-top boxes, gaming consoles, and so on.

The techniques described herein may be supported by these various configurations of the computing device 1002 and are not limited to the specific examples of the techniques described herein. This functionality may also be implemented all or in part through use of a distributed system, such as over a "cloud" 1020 via a platform 1022 as described below.

The cloud 1020 includes and/or is representative of a platform 1022 for resources 1024. The platform 1022 abstracts underlying functionality of hardware (e.g., servers) and software resources of the cloud 1020. The resources 1024 may include applications and/or data that can be utilized while computer processing is executed on servers that are remote from the computing device 1002. Resources 1024 can also include services provided over the Internet and/or through a subscriber network, such as a cellular or Wi-Fi network.

The platform 1022 may abstract resources and functions to connect the computing device 1002 with other computing devices. The platform 1022 may also serve to abstract scaling of resources to provide a corresponding level of scale to encountered demand for the resources 1024 that are implemented via the platform 1022. Accordingly, in an interconnected device embodiment, implementation of functionality described herein may be distributed throughout the system 1000. For example, the functionality may be implemented in part on the computing device 1002 as well as via the platform 1022 that abstracts the functionality of the cloud 1020.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A connector comprising:

one or more communication contacts to support transmission of data; and a receptacle secured within an opening of a printed circuit board, the receptacle having the one or more communication contacts disposed therein to support transmission of data upon contact with one or more communication contacts of a plug disposed within the receptacle, the receptacle having an angled outer edge, wherein the angled outer edge forms an angle, defined relative to a plane that is normal to an axis of the receptacle, that is configured to permit insertion and removal of the plug.

2. A connector as described in claim 1, wherein the outer edge of the receptacle includes at least three sides disposed at different positions along the axis, respectively.

3. A connector as described in claim 1, wherein the receptacle is secured to the opening in accordance with a mid-mount design configured to be secured to the printed circuit board.

4. A connector as described in claim 1, wherein the receptacle and the one or more communication contacts are configured for use as a display port receptacle, Universal Serial Bus receptacle, or audio jack.

5. A connector as described in claim 1, further comprising at least one contact disposed within the receptacle that is configured to transfer power.

6. A connector as described in claim 5, wherein the one or more communication contacts are not configured to support transfer of power.

7. A connector as described in claim 1, wherein the receptacle is configured to act as a support for a display device.

8. A connector as described in claim 1, wherein the receptacle includes a portion forming one or more openings to mimic vents of a housing of a computing device that includes the receptacle.

9. An apparatus comprising:

a housing configured to be held in one or more hands of a user;

a display device positioned at a side of the housing, a surface of the display device defining an axis; and a connector configured to provide a communicative coupling to a peripheral device and disposed on another side of the housing from that of the display device, the connector including a receptacle having a spring that includes a plurality of spring contacts formed as an integral part of the spring that flex in opposite directions in relation to each other generally along an axis normal to the surface of the display device in response to insertion of a plug into the receptacle.

10. An apparatus as described in claim 9, wherein the plug is formed as an audio plug and the connector is configured for use as an audio jack.

11. An apparatus as described in claim 9, wherein the spring is configured to surround at least three sides of the plug that are perpendicular to each other and physical contact is configured to be made between the spring and the plug solely through use of the spring contacts.

12. An apparatus as described in claim 9, wherein the connector is configured to act as a support for the display device.

13. An apparatus as described in claim 9, wherein a flexible printed circuit is connected to a side of the connector that is normal to the surface of the display device to support a communicative coupling to the spring and the plurality of spring contacts.

14. An apparatus as described in claim 13, wherein the surface defines an x and y axis and a z axis is defined a perpendicular to the surface, the flexible printed circuit being connected to the side of the connector disposed at one of the x or y axis and continuing along a side of the connector disposed along the z axis of the connector.

15. A computing device comprising:

a housing configured to be held by one or more hands of a user;

one or more computing components implemented at least partially in hardware and configured to perform one or more operations, the one or more computing components disposed within the housing;

a display device secured to the housing and configured to display a user interface generated by the one or more computing components; and a connector disposed in the housing and configured to provide a communicative coupling between the one or more computing components and a peripheral device, the connector including a receptacle having one or more communication contacts disposed therein that support the communicative coupling upon contact with one or more communication contacts of a plug disposed within the receptacle, the receptacle has an outer edge disposed at an angle that is not normal, generally, to an axis of the receptacle that permits insertion and removal of the plug.

16. A computing device as described in claim 15, wherein the axis is generally parallel to a plane defined by a surface of the display device.

17. A computing device as described in claim 15, wherein the connector is secured within an opening of a printed circuit board that includes the one or more computing components.

18. A computing device as described in claim 15, wherein the housing has a thickness of less than one centimeter.

19. A computing device as described in claim 15, wherein the receptacle and the one or more communication contacts disposed with the receptacle are configured for use as a display port receptacle, Universal Serial Bus receptacle, or audio jack.

20. A computing device as described in claim 15, wherein at least one of the communication contacts disposed within the receptacle is configured to transfer power.

* * * * *